United States Patent [19]

Lehmann et al.

[11] 4,091,862

[45] May 30, 1978

[54] GUIDING DEVICE FOR CONTINUOUSLY CAST METAL STRANDS AND THE LIKE

[75] Inventors: Rolf Lehmann, Rudolfstetten; Alfred Christ, Zurich, both of Switzerland

[73] Assignee: Escher Wyss Limited, Zurich, Switzerland

[21] Appl. No.: 786,370

[22] Filed: Apr. 11, 1977

[30] Foreign Application Priority Data

Apr. 13, 1976 Switzerland ..... 4666/76

[51] Int. Cl.[2] ..... B22D 11/12

[52] U.S. Cl. ..... 164/447; 164/441; 164/443

[58] Field of Search ..... 164/82, 441, 443, 447; 193/35 R

[56] References Cited

U.S. PATENT DOCUMENTS 2,169,893 8/1939 Crampton et al. ..... 164/441 X

*Primary Examiner*—Richard B. Lazarus

*Attorney, Agent, or Firm*—Pennie & Edmonds

[57] ABSTRACT

An apparatus is disclosed comprising a strand guide formed by guide plates which are supported and cooled by hydrostatic support elements. The support elements each include a cylinder and a piston which is stressed against the guide plate by pressure fluid supplied to the cylinder. The pistons are each provided with a bearing pad having a plurality of recesses each supplied with fluid at a constant rate which forms hydrostatic support for and cools the guide plates. The forces exerted by the support elements may be controlled by pressure regulating valves in the fluid supply lines leading thereto in response to sensors which sense positional shifts of the guide plates from a set point. The apparatus may also include a controller for the valves which periodically reduces the pressure of the fluid supplied to the support elements sufficiently to allow the casting to move along the strand guide.

33 Claims, 12 Drawing Figures

Figure 1:
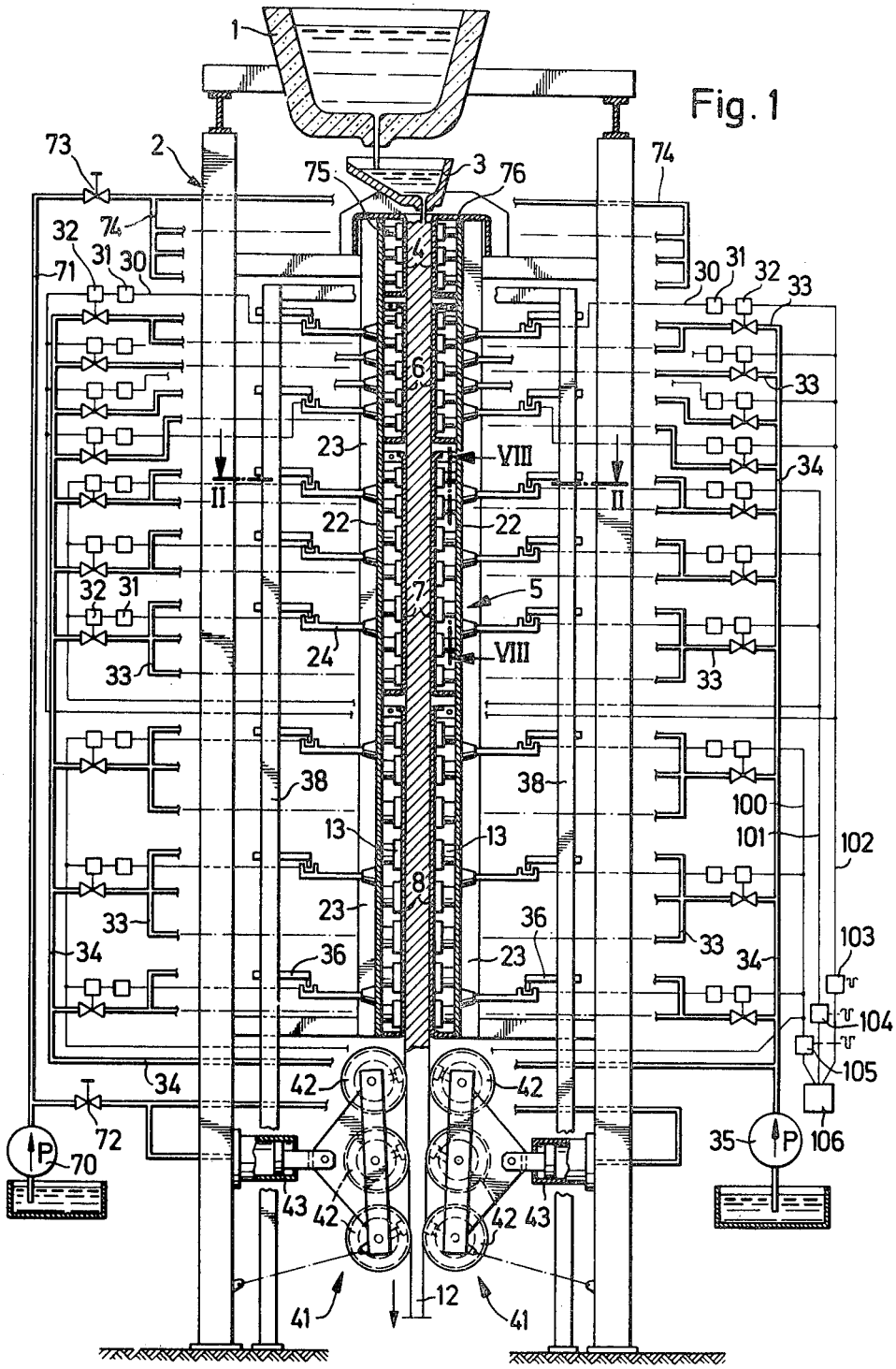

1
2
3
4
5
6
7
8
12
13
22
23
24
30
31
32
33
34
35
36
38
41
42
43
70
71
72
73
74
75
76
100
101
102
103
104
105
106
II
VIII
P

Fig. 10
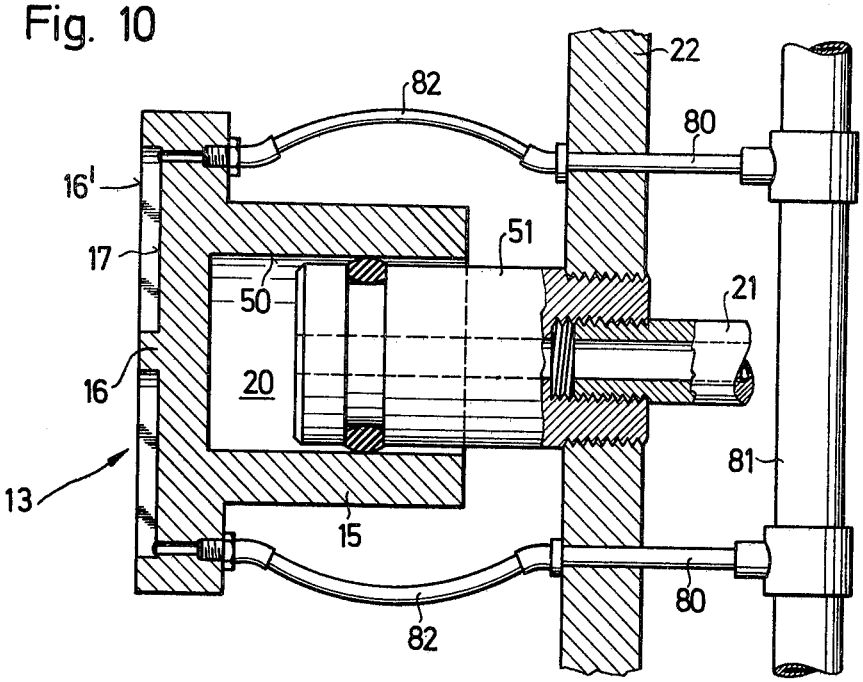
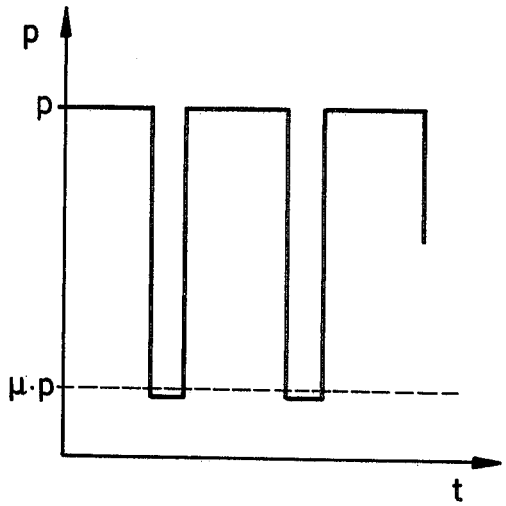
Fig. 11

GUIDING DEVICE FOR CONTINUOUSLY CAST METAL STRANDS AND THE LIKE

BACKGROUND OF THE INVENTION

1. Field of the Invention

The invention relates to an apparatus for guiding and cooling partially cooled castings in a continuous casting plant.

2. Description of the Prior Art

In continuous casting plants of the type to which this invention pertains, the hot metal casting or strand emerging from the mold moves along a strand guide formed by guide plates which bear against the casting and hence are subjected to very high temperatures. One such device for guiding the casting is disclosed, for example, in German Offenlegungsschrift No. 2,024,108. In the strand guide described therein, the guide plates are pressed by a pressure medium against the casting and are cooled by water sprayed on their inside surfaces. One disadvantage of such a device is that the contact pressure applying mechanism is relatively complicated. In addition, the water sprayed on the inside of the guide plates is often inadequate to cool them to a sufficiently low temperature so that plates, made from steel normally used in such applications, wear relatively rapidly. Furthermore, because in the device shown in the German Offenlegungsschrift, the guide plates are supported by point shaped supports, they must be relatively thick which renders cooling from the inside more difficult and, therefore, increases wear of the plates during operation. We have invented a strand guiding apparatus of a relatively simple construction which successfully avoids these disadvantages and in which the guide plates are intensively cooled.

SUMMARY OF THE INVENTION

In accordance with the invention, the strand guiding apparatus comprises guide plates disposed on opposite sides of the strand emerging from the mold and a plurality of hydrostatic support elements for exerting supporting forces on the guide plates. The support elements are mounted on a stationary frame and each of the elements includes a cylinder and a piston which defines with the cylinder a chamber therebetween. Hydraulic fluid introduced under pressure into the cylinder chambers stresses the pistons against the guide plates supporting them against the force exerted by the casting. The pistons each have a bearing pad provided with a plurality of recesses which are supplied with cooling fluid at a substantially constant rate with respect to time. The cooling fluid discharging from the recesses through a gap between the bearing pads and the associated guide plate produces hydrostatic support for the guide plates without direct metal-to-metal contact between the plates and the support elements. At the same time, the high velocity flow of fluid through the narrow gap also produces highly efficient and intensive cooling of the plates.

Since in the apparatus of the invention the guide plates are supported over a large surface area by the support elements, they can be made substantially thinner than was heretofore possible. The improved heat dissipation, due to the use of thinner guide plates and the improved cooling by the high velocity flow of coolant from the recesses in the bearing pads, significantly prolongs the service life of the guide plates since they can be maintained at a lower temperature during operation. The support system formed by the hydrostatic elements, moreover, not only enables the guide plates to be uniformly supported and results in more effective cooling, but, in addition, permits the distance between the guide plates to be adjusted in a relatively simple manner. This capability for rapid adjustment of the spacing between the guide plates and, hence the ability of the support system to accommodate castings of various cross-sections is, therefore, another important feature of the invention. In addition, this arrangement permits the forces applied by the support elements to be periodically reduced for short durations by briefly reducing the pressure of the fluid supplied to the cylinder chambers. Such brief periodic decreases in the pressure of the fluid, and the corresponding decreases in the forces applied against the guide plates, reduce the friction between the plates and the strand, permitting the casting to move along the strand guide. This mode of operation further reduces wear of the guide plates and extends their useful life.

Preferably, the piston of each support element is mounted in its cylinder for pivoting about the cylinder axis, and its bearing pad is provided with at least three recesses arranged in different straight lines in the manner of a multi-point support system. The recesses are connected by separate ducts to a source of coolant which supplies each recess with fluid at a substantially constant rate. This arrangement results in a very stable support system since it ensures that a uniform gap is maintained between the piston and the associated guide plate over the entire surface of the bearing pad, which in turn results in uniform distribution of the hydrostatic support forces and cooling of the plate.

Advantageously, each of the recesses in the bearing pad of the piston may be connected by a separate restrictor or throttling duct to a common source of coolant. This construction, thus, provides a simple and inexpensive means for supplying the recesses with fluid at a substantially constant rate with respect to time while at the same time retaining the capability of using two different fluids for the pressure medium and coolant.

In accordance with one embodiment of the invention, the piston of each support element is provided with restrictor ducts which connect each of the recesses with the cylinder chamber and with a bearing pad having a greater hydrostatically active area than the active area of the piston exposed to the pressure fluid in the cylinder chamber. This arrangement simplifies the construction and cost of the strand guide apparatus since the same fluid serves both as the pressure medium for stressing the pistons against the guide plates and coolant for cooling the plates.

The effectiveness of the support elements in cooling the guide plates is due in large part to the high heat transfer between the coolant and the plates because of the high velocity flow in the narrow gaps between the bearing pad and plate surfaces. The cooling effectiveness may therefore be increased by providing the pads with elongated recesses in the form of grooves so that a high velocity gap flow is produced over a larger area of the bearing surfaces with a concomitant increase in the rate of cooling. The cooling efficiency may be further increased by the provision of collecting grooves which are spaced from the elongated recesses and extend to the periphery of the bearing pads for facilitating the discharge of the coolant.

The apparatus preferably includes means to periodically reduce, for brief time intervals, the pressure of the sure of the fluid supplied, via distribution ducts 74, to hydrostatic support elements 75 supporting the mold 4. The construction of the support elements 75 can be identical to that of the elements 13 used to support the guide plates. However, since the plates 76 of the mold 4 are stationary, a pressure regulating circuit, such as that described with respect to elements 13, is not required to regulate the pressure of the fluid supplied to support elements 75.

Figure 2:
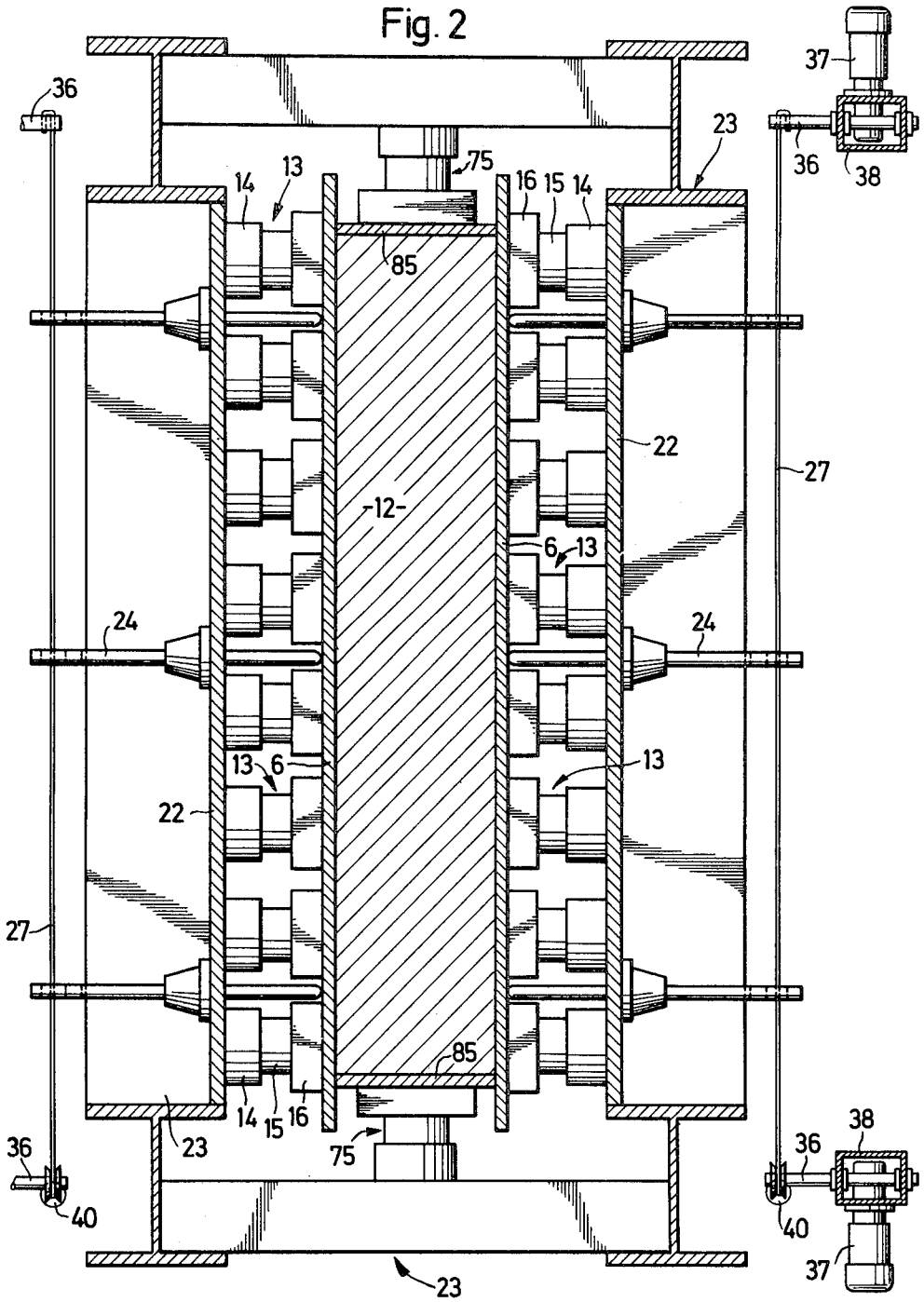

As can also be seen in FIG. 2, the strand 12 is guided laterally by guide plates 85. The guide plates 85 are supported by support elements 75 which may be of a construction identical to that of the support elements 75 of the mold 4. It will be understood that the construction of the support elements may also be identical to that of the support elements 13. In addition, sensors, such as the tracing sensor 24, may be provided together with the associated control circuit to regulate the pressure of the fluid supplied to the support elements acting on the lateral guide plates 85 in the manner described with reference to elements 13.

Referring again to FIG. 1, the pressure regulating valves 32 are connected by conductors 100, 101, and 102 to signal transducers 103, 104, and 105 which, when activated, transmit periodic signals of short duration to the valves 32. The signals from the transducers 103, 104, and 105 cause the associated valves 32 to briefly reduce the pressure of the fluid supplied to the corresponding support elements 13 and, therefore, reduce the forces they exert against the guide plates. This in turn produces a brief reduction in the contact force between the guide plates 6, 7, and 8 and strand 12 so that the strand can move downwardly along the guide 5.

The signal transducers 103, 104, and 105 are controlled by a control unit 106 which can be set, for example, to activate all of the transducers simultaneously causing them to send signals to the associated pressure regulating valves 32 so that the force applied to all the guide plates by the support elements is reduced simultaneously. The controller 106 may also be set to activate the transducers sequentially to in turn reduce the forces exerted on each guide plate along the strand guide in sequence, starting with the upstream guide plate 6, i.e., in the sequence 6, 7, 8, or starting with the downstream plate 8 in the sequence 8, 7, 6.

FIG. 11 shows a graph of the pressure characteristic in the support elements with respect to time during normal conditions and during the intervals when the pressure is reduced in response to signals from the transducers. Under normal operating conditions, a pressure $p$ is maintained by the tracing sensors 24 and the pressure regulating valves 32 at which the contact force applied by the support elements to the guide plates is in equilibrium with the ferrostatic pressure of the strand. Under these conditions, the friction between the strand and the guide plates is sufficiently large so that the strand cannot move readily between the plates of the strand guide. However, when the pressure $p$ is lowered briefly below a valve given by $\mu p$, where $\mu$ is the coefficient of friction between the affected guide plate and the strand, slight movement of the strand with respect to the plate is possible. Provided that the pressure reduction, and hence the decrease of the forces exerted against the guide plate by the support elements, is sufficiently rapid and of short duration, despite the ferrostatic pressure, the solidified skin of the casting will be unable to follow the slight lifting movement of the plate and restore the original state of equilibrium.

Figure 3:
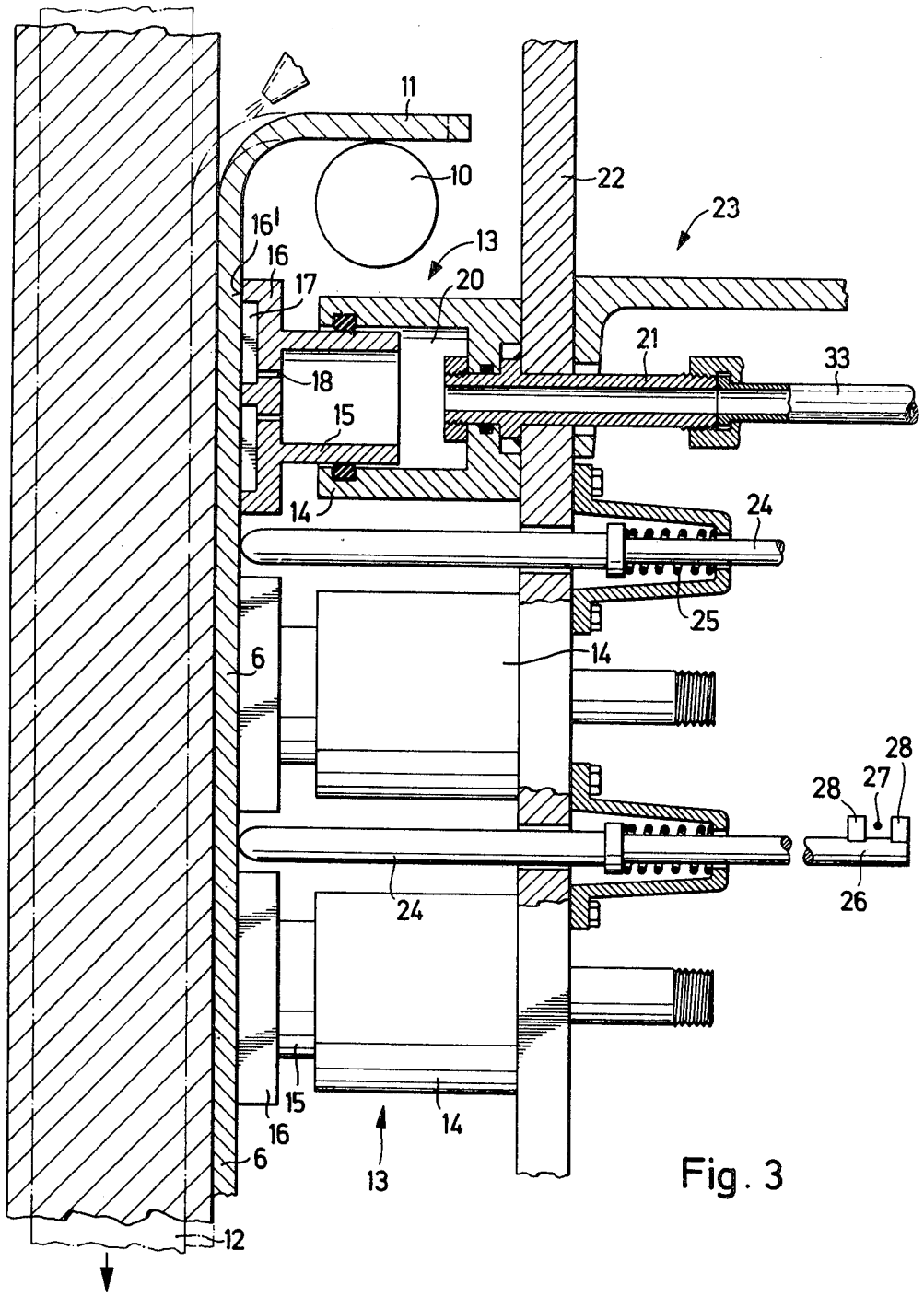
Figure 4:
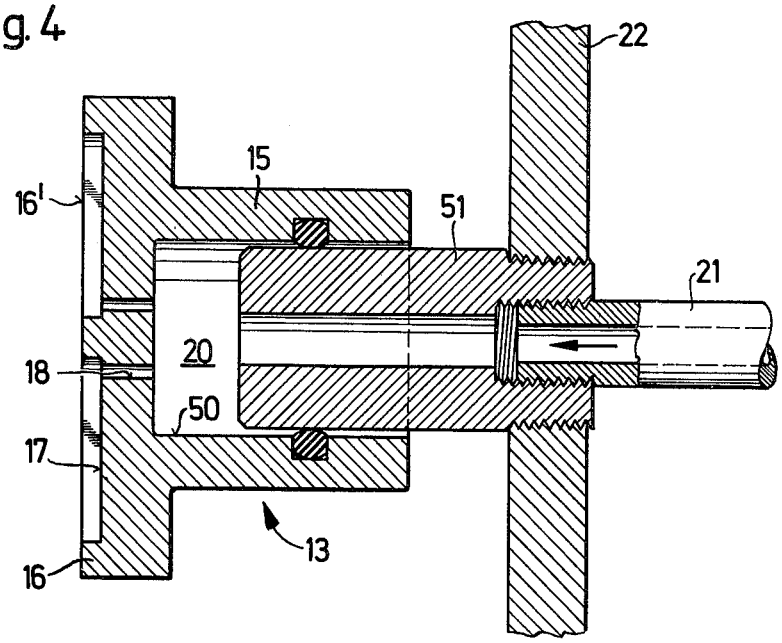

FIG. 4 shows another embodiment of the support element which may be used to support the guide plates in place of the support elements 13 shown in FIGS. 1 to 3. According to this embodiment, the piston 15 is also provided with a bearing pad 16 and has a cylindrical bore 50 in which a cylindrical member 51 slides in the manner of a plunger piston. The cylindrical member 51 is affixed to the support plate 22 and defines with the cylindrical cavity 50 a cylinder chamber therebetween which is supplied with fluid through an axial duct extending through member 51. The operation of the support element of FIG. 4 is in all other respects the same as that of the support elements 13 described with reference to FIGS. 1 to 3.

Figure 5:
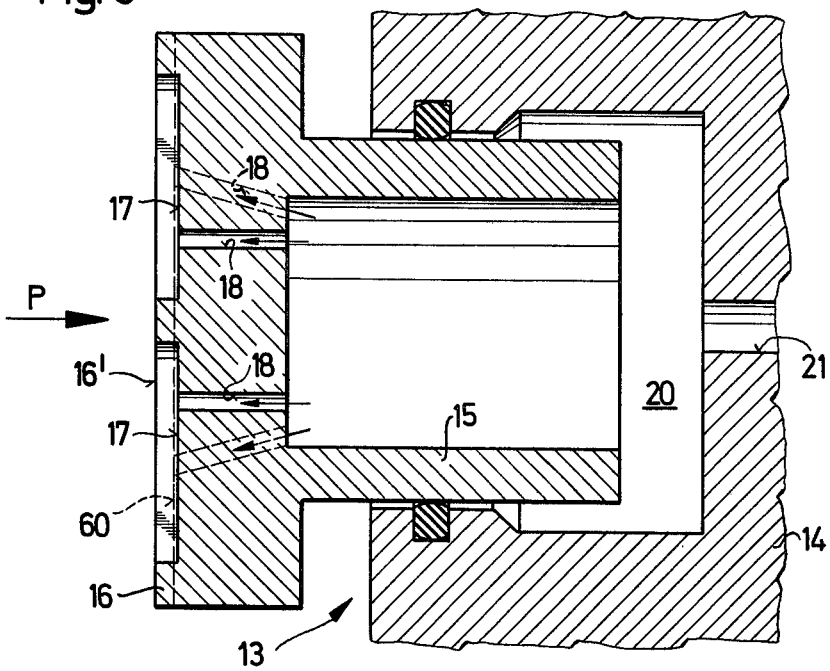
Figure 6:
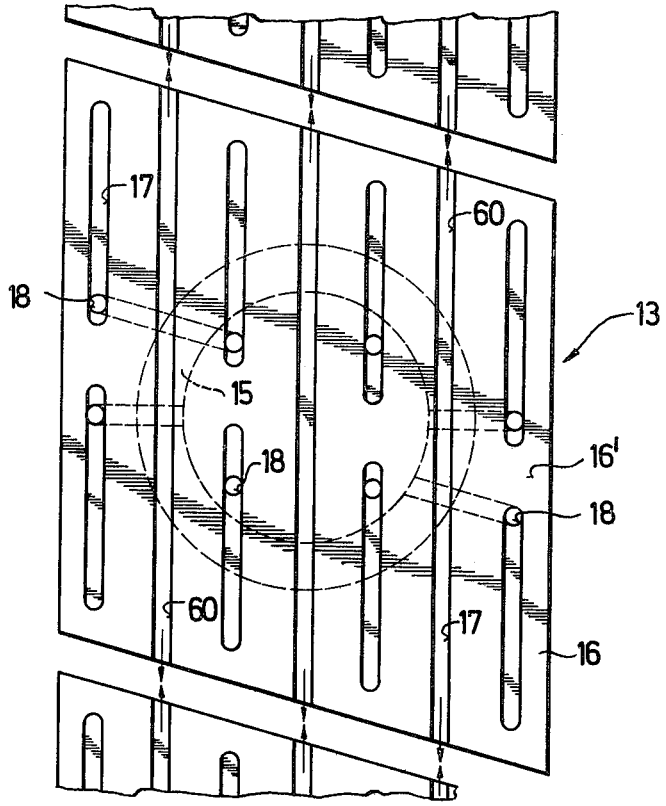
Figure 7:
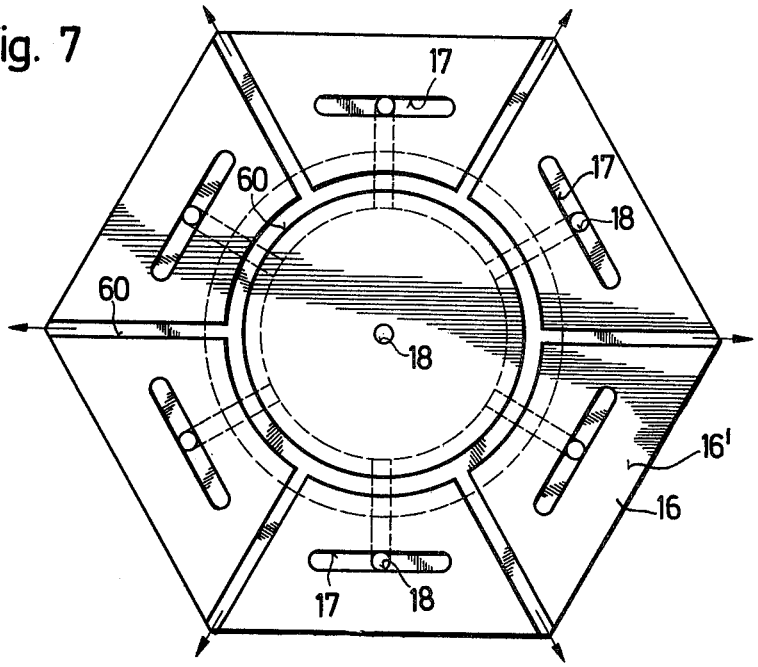

FIGS. 5, 6, and 7 show other constructions of the piston 15 illustrated in FIG. 3. As hereinabove described, the guide plates 6, 7, and 8 are cooled very effectively by the support elements because of the high heat transfer due to the high flow velocity of the fluid discharging through the gap between the piston pads and the associated guide plate. Accordingly, the heat transfer, and hence the cooling of the guide plates, can be further increased by constructing pad 16 so that the largest possible proportion of its bearing surface has such a high velocity gap flow in conjunction with the surface of the associated guide plate.

This is achieved in the embodiment shown in FIGS. 5 and 6 by providing the pads with elongated recesses in the form of grooves 17 which are supplied with fluid through ducts 18. To facilitate the discharge of the hydraulic fluid, which in this case also acts as the coolant, the grooves 17 are surrounded on their sides furthest from the periphery of the bearing surface 16' by collecting grooves 60 which extend to the boundary of the bearing surface. During operation of the piston, a gap flow with high heat transfer properties is thus produced between each groove 17 and a collecting groove 60, as well as between the grooves 17 and the outer edge of the bearing surface 16'. A hydrostatic contact pressure force, by means of which the associated guide plate is supported, is also simultaneously formed in the manner hereinabove described with reference to FIGS. 1 to 3. To achieve improved coverage of the associated guide plate, the bearing pads are in the form of parallelograms with inclined sides so that the sides of adjacent support elements overlap in the direction of the grooves as shown in FIG. 6. In addition, FIG. 5 shows in greater detail the arrangement for pivotally mounting the piston in the cylinder discussed earlier. As shown in the figure, the diameter of the piston is made sufficiently smaller than that of the cylinder to permit the piston to tilt with respect to the cylinder axis. An annular seal disposed in a circumferential groove in a projecting edge of the cylinder wall seals of the cylinder cavity.

In the embodiment of FIG. 7, the bearing surface of the bearing pad is hexagonal. As in the previous embodiment, the pad is also provided with elongated recesses 17 which are supplied with fluid through ducts 18 and collecting grooves 60 for increasing the gap flow coverage, as well as for facilitating the discharge of the fluid from the gap.

Figure 8:
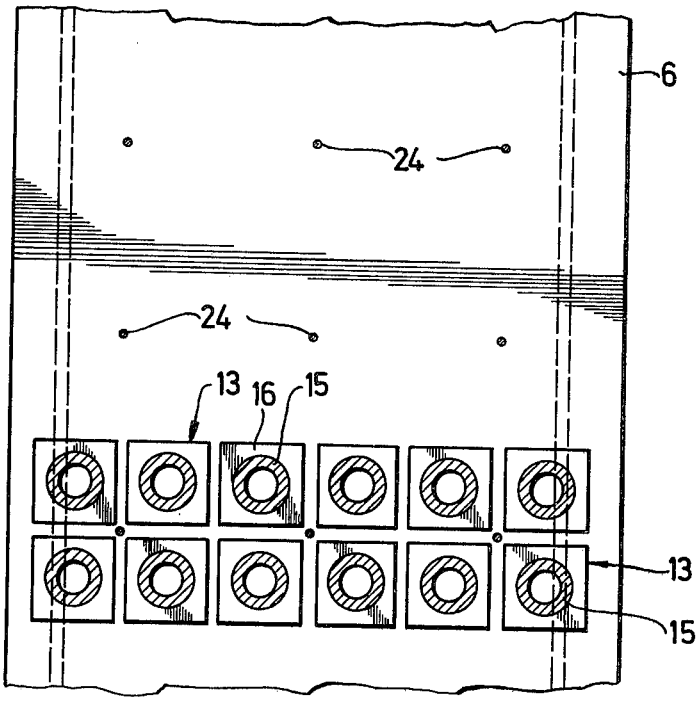
Figure 9:
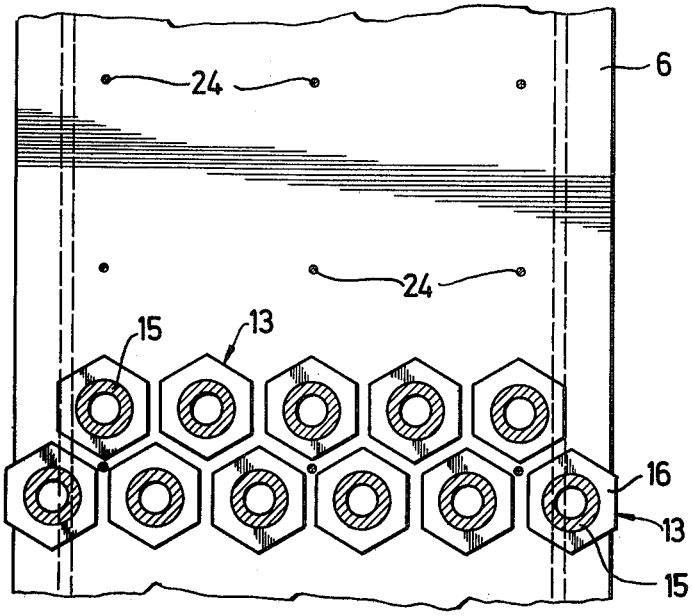

FIGS. 8 and 9 show two different arrangements of the support elements 13 and the tracing sensors 34. In the embodiment of FIG. 8, the support elements have square support surfaces, while FIG. 9 shows support elements with hexagonal bearing surfaces constructed in accordance with the embodiment of FIG. 7.

providing hydrostatic support. The recesses are arranged along different straight lines in a manner of a multipoint support system. For example, each bearing pad may be provided with three recesses 17 arranged in a triangle or with four such recesses arranged in a rectangle.

The recesses 17 are connected by restrictor or throttling ducts 18 to the cylinder chamber 20 of the associated cylinder 14. The cylinder chambers 20 of the support elements are supplied with a hydraulic pressure fluid through ducts 21 which are connected to conduits 33. The hydraulic fluid also serves as a coolant and may advantageously be water. In order to absorb the reaction forces of the support elements 13, the cylinders 14 are mounted on a support plate 22 which is part of the support frame 23.

In operation, hydraulic fluid, which also acts as a coolant, is supplied under pressure to the cylinder chambers 20 of the support elements 13 through the ducts 21. The pressure fluid in the cylinder forces the pistons 15 and their bearing pads 16 against the associated guide plates 6, 7, or 8. At the same time, the pressure fluid flows from the cylinder chambers 20 through the restrictor ducts 18 and into the recesses 17 in the bearing pads 16. As the fluid flows through the ducts 18, its pressure is reduced due to the restrictor or throttling action of the ducts so that it is supplied to the recesses 17 at a lower pressure than that of the fluid in the piston chambers 20. The restrictor ducts 18 also ensure that the quantity of the fluid supplied to the individual recesses remains independent of the discharge resistance of the flow from the recesses and therefore maintains with adequate accuracy a substantially constant flow rate during operation.

The hydrostatic effective area of the bearing surface 16' of the pads 16 is greater than the effective or active surface of the piston 15 exposed to the pressure fluid in the cylinder chamber 20. Although, due to the restrictor ducts, the pressure of the fluid supplied to the recesses is at a lower pressure than that of the fluid in the cylinder chambers, since the fluid at the bearing pad acts on a larger effective area, the pressure can build up in the recesses 17 until an equilibrium of the forces acting on the opposite ends of the piston is established.

The fluid in the recesses 17 ensures that a uniform gap is established between the bearing pad and the surface of the guide plate through which there is a constant flow of fluid which cools the plate as it is pressed against the hot metal strand. The guide plates 6, 7, and 8 are thus cooled and supported with a uniform hydrostatic force over a large surface area without direct metal-to-metal contact betwen the plates and the support elements. By arranging the support elements with sufficient density, significantly thinner plates can be used for guiding the casting than was heretofore possible. Moreover, the fluid discharging from the recesses of the support elements through the narrow gap between the bearing pads and the guide plates provides for a much more effective heat transfer, and hence, more efficient cooling than is possible by merely spraying the plates with water as in conventional cooling methods. In addition, because this construction permits the use of thinner guide plates, the heat dissipation is improved, which, together with the improved thermal transfer to the coolant, reduces wear of the guide plates since they can be cooled to lower temperatures than those attainable in continuous casting plants of conventional design.

The pressure of the fluid supplied to the support elements, and hence the forces they exert against the guide plates, is regulated in accordance with the position of the guide plates as sensed by tracing sensors 24. As shown in FIGS. 1 to 3, the tracing sensors 24 are in the form of rods which extend through apertures in the support plate 22 and are forced against the associated guide plate 6, 7, or 8 by springs 25 disposed in retainer housings attached to the support plate 22. The opposite ends of the tracing sensors are provided with a fork 26 having a pair of arms 28 between which passes a steel wire 27 extending in a direction parallel to the guide plates. The fork 26 is provided with an electromagnetic proximity sensor (not shown) which may, for example, include an electromagnetic element disposed in each of the fork arms 28 and connected into a bridge circuit. As illustrated in FIG. 1, the proximity sensor in fork 26 is connected through a signal conductor 30 to a regulator 31 which controls a pressure regulating restrictor element or valve 32 in branch lines 33 leading to the support elements 13. The branch lines 33 are connected to a common fluid supply line 34 leading to a feed pump 35.

As can be seen in FIG. 2, a wire 27 is associated with each row of tracing sensors 24. The wire is stretched between arms 36 of a measuring strand 38 by, for example, attaching one of its ends to one arm 36 and passing the other end, which is loaded by a weight 40, over a roller mounted in a second arm 36. The position of the arms 36, and hence the position of the wire with respect to the guide plate and forks 26 of the tracing sensors 24, may be adjusted by means of servo motors 37. The measuring stand is constructed independently of the support frame 23 so that it is not affected by deformations of the frame under load.

The position of the wire 27 is initially adjusted so that it passes through the middle of the fork 26 for a predetermined position of the tracing sensors and the associated guide plates 6, 7, and 8. In operation, positional shifts of the guide plates cause corresponding shifts in the position of the wire with respect to the fork arms 28, since the tracing sensor follows the movements of the plate, and produce a signal which is sent to regulators 31. In response to the signal, which is indicative of the shift of the plate from the predetermined position or set point, the regulators 31 adjust restrictor elements 32 to accordingly change the pressure of the fluid supplied to the individual support elements 13. This arrangement, thus, defines in a simple manner the set point position of the guide plates 6, 7, and 8 during operation.

As further shown in FIG. 1, two groups of rolls 41, each having three rolls 42, are disposed beneath the strand guide 5 with its guide plates 6, 7, and 8. The rolls of the two groups are pressed against the strand 12 by hydraulic piston-cylinder units 43. Advantageously, the rolls 42 can be flexure controlled rolls of the type shown, for example, in U.S. Patent No. 3,802,044, which have hydraulic support pistons adapted to uniformly support a tubular shell.

As also shown in FIG. 1, a second feed pump 70, connected to a fluid delivery line 71, is provided in addition to the pump 35 supplying fluid to the support elements 13 via lines 33 and 34. One branch conduit leading from the main fluid supply line 71 is connected to a pressure regulating element or valve 72 for supplying fluid at a suitable pressure to the piston-cylinder unit 43. The other branch of the line 71 is connected to a pressure regulating element 73 which controls the pressure of the fluid supplied, via distribution ducts 74, to hydrostatic support elements 75 supporting the mold 4. The construction of the support elements 75 can be identical to that of the elements 13 used to support the guide plates. However, since the plates 76 of the mold 4 are stationary, a pressure regulating circuit, such as that described with respect to elements 13, is not required to regulate the pressure of the fluid supplied to support elements 75.

As can also be seen in FIG. 2, the strand 12 is guided laterally by guide plates 85. The guide plates 85 are supported by support elements 75 which may be of a construction identical to that of the support elements 75 of the mold 4. It will be understood that the construction of the support elements may also be identical to that of the support elements 13. In addition, sensors, such as the tracing sensor 24, may be provided together with the associated control circuit to regulate the pressure of the fluid supplied to the support elements acting on the lateral guide plates 85 in the manner described with reference to elements 13.

Referring again to FIG. 1, the pressure regulating valves 32 are connected by conductors 100, 101, and 102 to signal transducers 103, 104, and 105 which, when activated, transmit periodic signals of short duration to the valves 32. The signals from the transducers 103, 104, and 105 cause the associated valves 32 to briefly reduce the pressure of the fluid supplied to the corresponding support elements 13 and, therefore, reduce the forces they exert against the guide plates. This in turn produces a brief reduction in the contact force between the guide plates 6, 7, and 8 and strand 12 so that the strand can move downwardly along the guide 5.

The signal transducers 103, 104, and 105 are controlled by a control unit 106 which can be set, for example, to activate all of the transducers simultaneously causing them to send signals to the associated pressure regulating valves 32 so that the force applied to all the guide plates by the support elements is reduced simultaneously. The controller 106 may also be set to activate the transducers sequentially to in turn reduce the forces exerted on each guide plate along the strand guide in sequence, starting with the upstream guide plate 6, i.e., in the sequence 6, 7, 8, or starting with the downstream plate 8 in the sequence 8, 7, 6.

FIG. 11 shows a graph of the pressure characteristic in the support elements with respect to time during normal conditions and during the intervals when the pressure is reduced in response to signals from the transducers. Under normal operating conditions, a pressure $p$ is maintained by the tracing sensors 24 and the pressure regulating valves 32 at which the contact force applied by the support elements to the guide plates is in equilibrium with the ferrostatic pressure of the strand. Under these conditions, the friction between the strand and the guide plates is sufficiently large so that the strand cannot move readily between the plates of the strand guide. However, when the pressure $p$ is lowered briefly below a valve given by $\mu p$, where $\mu$ is the coefficient of friction between the affected guide plate and the strand, slight movement of the strand with respect to the plate is possible. Provided that the pressure reduction, and hence the decrease of the forces exerted against the guide plate by the support elements, is sufficiently rapid and of short duration, despite the ferrostatic pressure, the solidified skin of the casting will be unable to follow the slight lifting movement of the plate and restore the original state of equilibrium.

FIG. 4 shows another embodiment of the support element which may be used to support the guide plates in place of the support elements 13 shown in FIGS. 1 to 3. According to this embodiment, the piston 15 is also provided with a bearing pad 16 and has a cylindrical bore 50 in which a cylindrical member 51 slides in the manner of a plunger piston. The cylindrical member 51 is affixed to the support plate 22 and defines with the cylindrical cavity 50 a cylinder chamber therebetween which is supplied with fluid through an axial duct extending through member 51. The operation of the support element of FIG. 4 is in all other respects the same as that of the support elements 13 described with reference to FIGS. 1 to 3.

FIGS. 5, 6, and 7 show other constructions of the piston 15 illustrated in FIG. 3. As hereinabove described, the guide plates 6, 7, and 8 are cooled very effectively by the support elements because of the high heat transfer due to the high flow velocity of the fluid discharging through the gap between the piston pads and the associated guide plate. Accordingly, the heat transfer, and hence the cooling of the guide plates, can be further increased by constructing pad 16 so that the largest possible proportion of its bearing surface has such a high velocity gap flow in conjunction with the surface of the associated guide plate.

This is achieved in the embodiment shown in FIGS. 5 and 6 by providing the pads with elongated recesses in the form of grooves 17 which are supplied with fluid through ducts 18. To facilitate the discharge of the hydraulic fluid, which in this case also acts as the coolant, the grooves 17 are surrounded on their sides furthest from the periphery of the bearing surface 16' by collecting grooves 60 which extend to the boundary of the bearing surface. During operation of the piston, a gap flow with high heat transfer properties is thus produced between each groove 17 and a collecting groove 60, as well as between the grooves 17 and the outer edge of the bearing surface 16'. A hydrostatic contact pressure force, by means of which the associated guide plate is supported, is also simultaneously formed in the manner hereinabove described with reference to FIGS. 1 to 3. To achieve improved coverage of the associated guide plate, the bearing pads are in the form of parallelograms with inclined sides so that the sides of adjacent support elements overlap in the direction of the grooves as shown in FIG. 6. In addition, FIG. 5 shows in greater detail the arrangement for pivotally mounting the piston in the cylinder discussed earlier. As shown in the figure, the diameter of the piston is made sufficiently smaller than that of the cylinder to permit the piston to tilt with respect to the cylinder axis. An annular seal disposed in a circumferential groove in a projecting edge of the cylinder wall seals of the cylinder cavity.

In the embodiment of FIG. 7, the bearing surface of the bearing pad is hexagonal. As in the previous embodiment, the pad is also provided with elongated recesses 17 which are supplied with fluid through ducts 18 and collecting grooves 60 for increasing the gap flow coverage, as well as for facilitating the discharge of the fluid from the gap.

FIGS. 8 and 9 show two different arrangements of the support elements 13 and the tracing sensors 34. In the embodiment of FIG. 8, the support elements have square support surfaces, while FIG. 9 shows support elements with hexagonal bearing surfaces constructed in accordance with the embodiment of FIG. 7.

In the embodiments hereinabove described, the hydraulic fluid supplied to the support element which, as stated earlier can be water, acts both as the pressure medium for applying the contact force to the guide plates and also as the coolant for cooling the plates. It is also possible to use two different fluids for the coolant and the pressure medium. For example, unpurified water can be used for the coolant while hydraulic fluid or purified water with additives is used for the pressure fluid.

FIG. 10 shows an embodiment of the support element suitable in such applications using two different fluids for the pressure medium and coolant. The embodiment of FIG. 10 is substantially similar to the support element shown in FIG. 4 and corresponding parts have the same reference symbols.

In the support element of FIG. 10, coolant is supplied to the bearing pad recesses 17 through connecting ducts 80 from a common coolant supply line 81. The ducts 80 have restrictors which function in a manner similar to the ducts 18 described with reference to the embodiments of FIGS. 1 to 4 ensure that the coolant is supplied to the recesses at a substantially constant rate and a uniform distribution of the coolant over the individual recesses 17. The connecting ducts 80 are also provided with flexible hoses 82 which allow the piston 15 to move freely with respect to the fixed plunger member 51. The piston chamber 20 of the cylindrical cavity 50 is supplied with pressure fluid from line 21 through a duct extending axially through member 51 which forces the piston 15 toward the associated guide plate.

Figure 12:
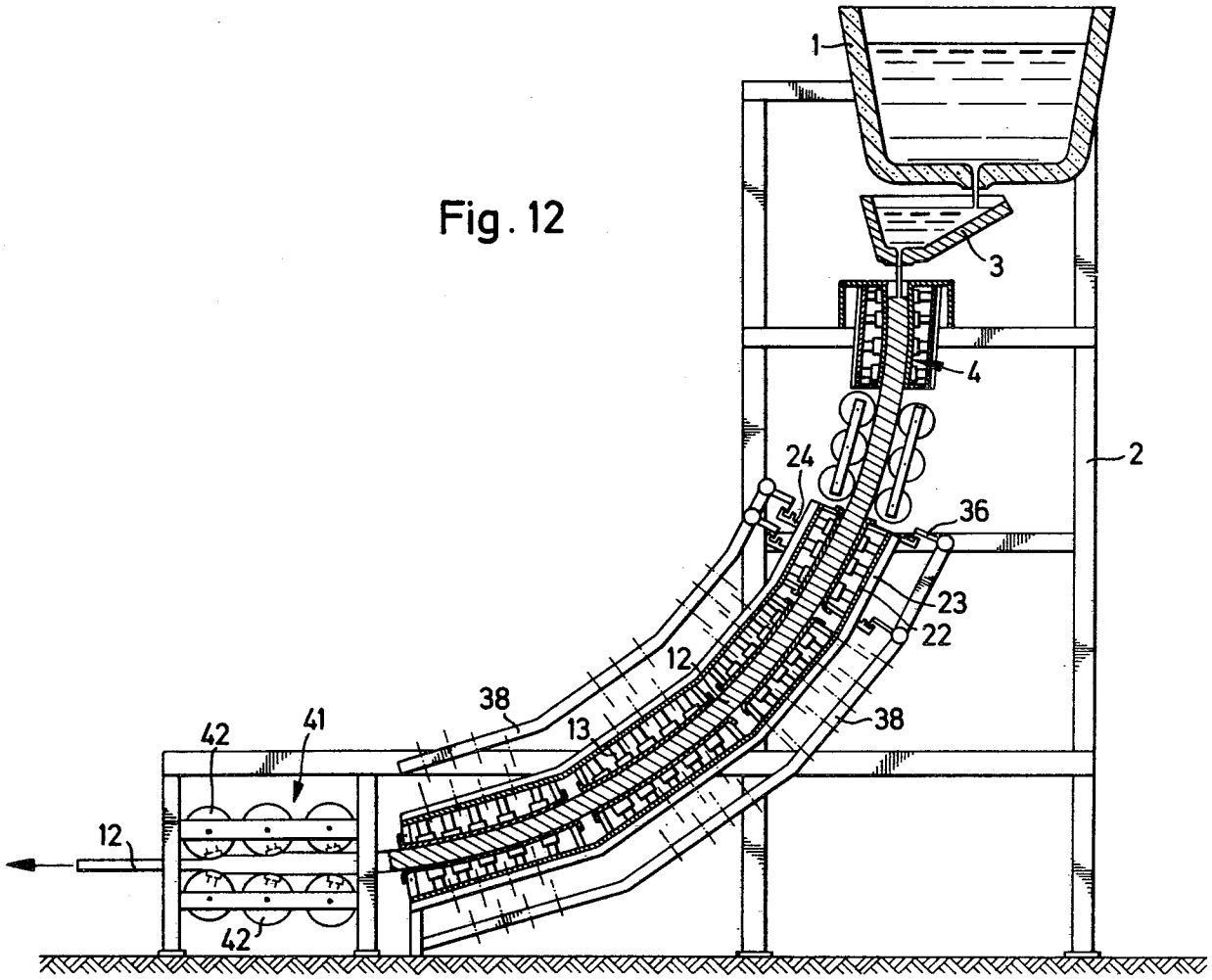

Although in the embodiment of FIGS. 1 to 3, the apparatus of the invention is shown and described with reference to a vertical or "stick" casting operation, it can also be used in continuous casting plants of the "vertical-plus-bending" type in which the casting is bent from the vertical to a horizontal position. As shown in FIG. 12, in this type of operation, the guide plates and the associated support elements mounted on support frame 23 are arranged in an arc which deflects the strand 12 emerging from the mold 4 so that after passing through the roller unit 42, it is in a horizontal position. The operation of this embodiment is essentially similar to that of FIGS. 1 to 3 hereinabove described.

We claim:

1. An apparatus for guiding castings such as continuously cast metal strands which comprises at least one guide plate for supporting at least one surface of the casting, a support frame, a plurality of hydrostatic support elements arranged on said frame to exert support forces on the side of said guide plate furthest from the casting, each of said support elements including a cylinder and a piston guided by said cylinder in a direction substantially perpendicular to the plane of said plate, said piston defining with said cylinder a chamber therebetween, means for introducing fluid under pressure into said chambers for urging said pistons toward said guide plate, each piston having a bearing portion on the end thereof adjacent said guide plate and at least one recess formed in said bearing portion, and means for supplying fluid to each recess at a substantially constant rate with respect to time which forms hydrostatic support for and cools said guide plate.

2. Apparatus according to claim 1 wherein each piston is mounted in the associated cylinder for pivoting about the cylinder axis and has at least three of said recesses formed in said bearing portion thereof.

3. Apparatus according to claim 2 wherein said recesses are arranged in different straight lines.

4. Apparatus according to claim 2 wherein said fluid supply means includes a separate restrictor duct communicating each recess with a common source of fluid.

5. Apparatus according to claim 2 wherein said fluid supply means includes a separate restrictor duct connecting each recess of said piston of at least one of said support elements to the associated chamber, said bearing portion of said piston having a greater hydrostatically effective area than the effective area of said piston exposed to pressure fluid in said chamber.

6. Apparatus according to claim 5 wherein said fluid is water.

7. Apparatus according to claim 1 wherein said piston of at least one of said support elements has a cylindrical axially extending cavity defining said cylinder, said at least one element further including a cylindrical member affixed to said frame which extends into said cavity and defines therewith said chamber therebetween, said fluid introducing means including a duct extending through said cylindrical member and communicating with said chamber.

8. Apparatus according to claim 7 wherein said fluid supplying means includes a separate restrictor duct formed in said piston for connecting each recess with said chamber, said bearing portion of said piston having a hydrostatically active area greater than the active area of said piston exposed to pressure fluid in said chamber.

9. Apparatus according to claim 7 wherein said fluid introducing means includes a source of pressure fluid and means for connecting said pressure fluid source with said duct, and wherein said fluid supply means includes a source of cooling fluid separate from said source of pressure fluid and conduit means for connecting said cooling fluid source with each recess, said conduit means including a restrictor duct and a flexible conduit to permit movement of said piston with respect to said cylindrical member.

10. Apparatus according to claim 1 wherein said piston of at least one of said support elements has a plurality of said recesses in the form of elongated grooves which terminate short of the periphery of said bearing portion.

11. Apparatus according to claim 10 wherein said piston has at least one collecting groove formed in said bearing surface, said collecting groove being spaced from one of said elongated recesses and extending to the periphery of said bearing portion for the discharge of fluid flowing from said recesses.

12. Apparatus according to claim 11 wherein said bearing portion of said piston is rectangular and wherein said elongated recesses and said collecting groove are both parallel to one side of said bearing portion.

13. Apparatus according to claim 1 wherein said bearing portion of each piston has the shape of a parallelogram, said support elements being arranged such that the sides of the bearing portions of two adjacent support elements overlap.

14. Apparatus according to claim 13 wherein each bearing portion has a plurality of said recesses in the form of elongated grooves which are generally parallel to each other and terminate short of the periphery of said bearing portion and a collecting groove adjacent to and spaced from each elongated recess which is generally parallel to said elongated recess and extends to the periphery of said bearing portion.

15. Apparatus according to claim 1 wherein said bearing portion of each piston is hexagonal and has a plurality of said recesses which are elongated and terminate short of the periphery of said bearing portion.

16. Apparatus according to claim 15 wherein at least one of said recesses is disposed adjacent each side of said bearing portion and is substantially parallel thereto, said bearing portion further having a circular collecting groove extending about the axis of said piston and at least one collecting groove extending from said circular groove to the periphery of said bearing portion between each pair of adjacent recesses.

17. Apparatus according to claim 1 including means for sensing shift of said guide plate from a predetermined position and means responsive to said sensing means for independently regulating the pressure of said fluid introduced into said chambers of groups of said support elements each having at least one element.

18. Apparatus according to claim 17 wherein said sensing means includes at least one sensor for sensing said positional shift of said guide plate and a stand for supporting said sensor independently of said frame supporting said hydrostatic elements.

19. Apparatus according to claim 18 wherein said fluid introducing means includes a conduit for supplying said pressure fluid to each group of support elements and said pressure regulating means includes a fluid pressure regulating valve in each of said conduits.

20. Apparatus according to claim 19 wherein said sensor includes a wire stretched in said stand in a direction substantially parallel to said plane of said guide plate and spaced therefrom, a tracing member abutting said guide plate and displaceable therewith, and means for detecting shifts in position of said tracing member with respect to said wire upon displacement of said guide plate from said predetermined position.

21. Apparatus according to claim 1 including means for periodically reducing the pressure of the fluid supplied to said chambers of said support elements sufficiently to allow the casting to move with respect to said guide plate.

22. Apparatus according to claim 21 wherein said fluid introducing means includes a source of pressure fluid and at least one conduit for connecting said source with said chambers, said pressure reducing means including a control device and a pressure regulating valve responsive thereto in each conduit.

23. Apparatus according to claim 22 wherein the pressure of the fluid supplied to all of said support elements is reduced simultaneously.

24. Apparatus according to claim 22 including a plurality of said conduits each supplying fluid to a different group of said support elements each having at least one element.

25. Apparatus according to claim 24 wherein the pressure of the fluid supplied to separate groups of elements along the length of the casting is reduced sequentially.

26. Apparatus according to claim 1 wherein said guide plate is generally vertical.

27. Apparatus according to claim 26 including a mold disposed above said guide plate for forming the casting and at least one additional hydrostatic element arranged on said frame to exert a support force on at least one side of said mold.

28. Apparatus according to claim 26 including a guide plate for supporting each side of the casting, said support elements being arranged on said frame to exert support forces on each guide plate.

29. Apparatus according to claim 1 including a plurality of said guide plates for supporting each of the two opposite sides of the casting therebetween, said guide plates being arranged in an arc in a vertical plane and defining an arcuate path for bending the casting from a vertical to a horizontal position, said support elements being arranged on said frame to exert support forces on each of said guide plates.

30. An apparatus for guiding castings such as continuously cast metal strands which comprises at least two guide plates for supporting the casting therebetween, a support frame, a plurality of hydrostatic support elements arranged on said frame to exert support forces on each guide plate, each of said support elements including a cylinder and a piston guided by said cylinder in a direction generally perpendicular to the plane of the associated plate and mounted for pivoting about the axis of said cylinder, said piston defining with said cylinder a chamber therebetween, means for supplying fluid under pressure to each chamber for urging said pistons toward said guide plates, each piston having a bearing portion on the end thereof adjacent the respective guide plate, a plurality of recesses formed in said bearing portion and a separate restrictor duct connecting each recess with the associated chamber for supplying fluid from said chamber to said recesses at a substantially constant rate with respect to time, said bearing portions each having a greater hydrostatically effective area than the effective area of the respective piston exposed to pressure in the associated chamber so that the fluid discharging from said recesses through narrow gaps formed between the respective bearing portions and the guide plates forms hydrostatic support for and cools said plates.

31. Apparatus according to claim 30 wherein said recesses are elongated and each bearing portion has at least one collecting groove extending to the periphery of said bearing portion spaced from at least one of said elongated recess.

32. Apparatus according to claim 31 including means for sensing shift of said guide plates from a predetermined position and means responsive to said sensing means for independently regulating the pressure of said fluid supplied to separate groups of said support elements each having at least one element.

33. Apparatus according to claim 32 including means for periodically reducing the pressure of the fluid supplied to said support elements sufficiently to allow the casting to move between said guide plates.

* * * * *

UNITED STATES PATENT AND TRADEMARK OFFICE

CERTIFICATE OF CORRECTION

PATENT NO. : 4,091,862

DATED : May 30, 1978

INVENTOR(S) : Rolf Lehmann and Alfred Christ

It is certified that error appears in the above-identified patent and that said Letters Patent are hereby corrected as shown below:

Column 4, line 66, "when the late is" should read
-- when the plate is --

Column 5, line 20, after "cylinder" insert
-- chambers --

Column 5, line 39, after "the" second occurrence, insert
-- action of the --

Column 9, line 22, after "4" insert
-- to --

Signed and Sealed this

*Second* Day of *January 1979*

[SEAL]

*Attest:*

RUTH C. MASON
*Attesting Officer*

DONALD W. BANNER
*Commissioner of Patents and Trademarks*